US011384665B2

(12) United States Patent
Ferront

(10) Patent No.: US 11,384,665 B2
(45) Date of Patent: Jul. 12, 2022

(54) MUFFLER

(71) Applicant: Eberspächer Exhaust Technology GmbH & Co. KG, Neunkirchen (DE)

(72) Inventor: Hervé Ferront, Esslingen (DE)

(73) Assignee: PUREM GMBH, Neunkirchen (DE)

( * ) Notice: Subject to any disclaimer, the term of this patent is extended or adjusted under 35 U.S.C. 154(b) by 471 days.

(21) Appl. No.: 16/453,103

(22) Filed: Jun. 26, 2019

(65) Prior Publication Data

US 2020/0003093 A1 Jan. 2, 2020

(30) Foreign Application Priority Data

Jun. 29, 2018 (DE) ..... 10 2018 115 742.8

(51) Int. Cl.
*F01N 1/00* (2006.01)
*F01N 1/10* (2006.01)

(52) U.S. Cl.
CPC ..... *F01N 1/006* (2013.01); *F01N 1/10* (2013.01); *F01N 2470/02* (2013.01)

(58) Field of Classification Search
CPC . F01N 1/006; F01N 1/026; F01N 1/10; F01N 1/12; F01N 2470/02
See application file for complete search history.

(56) References Cited

U.S. PATENT DOCUMENTS 1,732,818 A 10/1929 Oldberg
4,589,517 A * 5/1986 Fukuda ..... F01N 1/006 181/256
5,025,890 A * 6/1991 Hisashige ..... F01N 1/02 181/256
5,227,593 A * 7/1993 Takahashi ..... F01N 1/02 181/255
5,708,238 A 1/1998 Asao et al.
6,467,570 B1 * 10/2002 Herold ..... F01N 3/0226 181/231
6,968,922 B2 * 11/2005 Kawamata ..... F01N 1/083 181/231
7,434,658 B2 * 10/2008 Staut ..... F01N 1/083 181/271

(Continued)

FOREIGN PATENT DOCUMENTS

DE 2827237 A1 2/1979
DE 29808058 U1 8/1998
EP 0475398 A1 3/1992

*Primary Examiner* — Jeremy A Luks
(74) *Attorney, Agent, or Firm* — McGlew and Tuttle, P.C.

(57) ABSTRACT

A muffler, for an internal combustion engine exhaust system, includes a muffler housing (12) with a housing jacket (14) elongated in a housing longitudinal axis (A) direction and with an outer panel (16) connected to the housing jacket at both axial end areas thereof to define a muffler interior (18). An inner panel (20) is arranged in and divides the muffler interior. A muffling unit (24) includes an exhaust-gas-carrying inner pipe (26), an outer pipe (28) enclosing the inner pipe and muffling material (32) arranged between the inner pipe and the outer pipe. The inner pipe is accommodated in an opening (48) of an inner panel and in an opening (40) of one of the outer panels or of an additional inner panel. The outer pipe is permanently connected to the inner panel or/and to one of the outer panels or to the additional inner panel.

20 Claims, 1 Drawing Sheet

(56) References Cited

U.S. PATENT DOCUMENTS

| | | | | |
|---|---|---|---|---|
| 8,701,824 | B2 * | 4/2014 | Hayama | F01N 3/2885<br>181/228 |
| 10,900,396 | B2 * | 1/2021 | Ayesh | F01N 1/006 |
| 2014/0251718 | A1 * | 9/2014 | Yasoshina | F01N 1/083<br>181/211 |
| 2016/0281557 | A1 * | 9/2016 | Nakano | F01N 1/003 |
| 2021/0300972 | A1 * | 9/2021 | Yamada | C07K 19/00 |

* cited by examiner

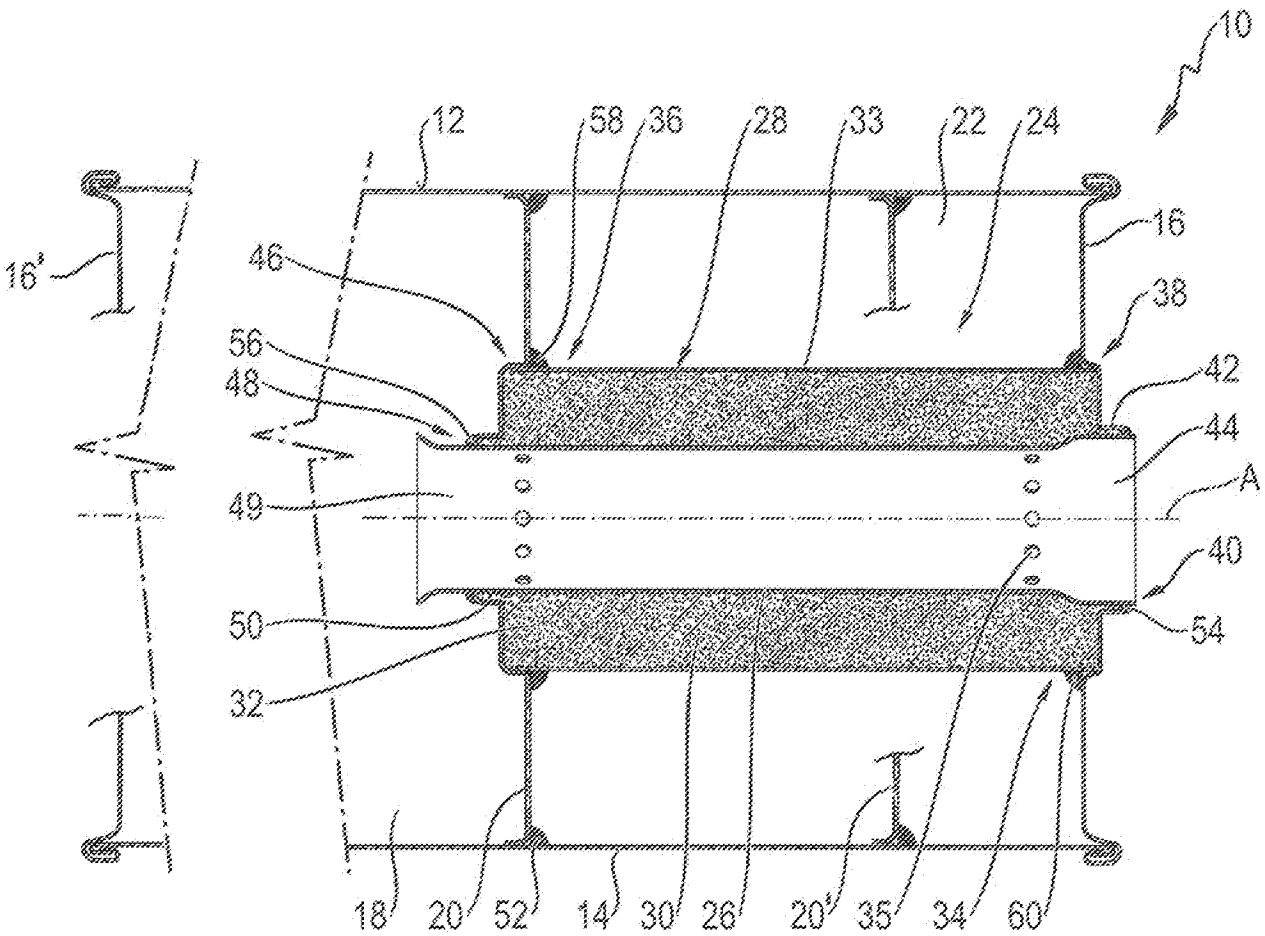
10
16
38
42
44
A
40
54
24
22
33
28
36
58
12
46
56
48
49
50
32
16'
60
34
35
20
26
30
14
52
20
18

MUFFLER

CROSS REFERENCE TO RELATED APPLICATIONS

This application claims the benefit of priority under 35 U.S.C. § 119 of German Application 10 2018 115 742.8, filed Jun. 29, 2018, the entire contents of which are incorporated herein by reference.

TECHNICAL FIELD

The present invention pertains to a muffler, which can be provided in a vehicle, for example, as a rear muffler in an exhaust system of an internal combustion engine.

TECHNICAL BACKGROUND

Using muffling units, which are also called "bombs" and comprise an exhaust-gas-carrying inner pipe, an outer pipe enclosing this inner pipe and muffling material arranged in an intermediate space between the inner pipe and the outer pipe, is known for lowering the noise level as much as possible.

SUMMARY

An object of the present invention is to provide a muffler, especially a rear muffler, for an exhaust system of an internal combustion engine, in which a simplified assembly of the various components or assembly units of same is made possible.

This object is accomplished according to the present invention by a muffler, especially rear muffler, for an exhaust system of an internal combustion engine, comprising a muffler housing with a housing jacket elongated in the direction of a housing longitudinal axis and with an outer panel connected to the housing jacket at both axial end areas of the housing jacket, wherein the housing jacket defines with the outer panel a muffler interior, and at least one inner panel dividing the muffler interior is arranged in the muffler interior, further comprising a muffling unit with an exhaust-gas-carrying inner pipe, with an outer pipe enclosing the inner pipe and muffling material arranged between the inner pipe and the outer pipe, wherein the inner pipe is accommodated in an opening of an inner panel and in an opening of one of the outer panels or of an additional inner panel, and the outer pipe is permanently connected to the inner panel or/and to one of the outer panels or to the additional inner panel.

Because the muffling unit is connected in this muffler configured according to the present invention via the outer pipe to an inner panel or/and to one of the outer panels or to at least one of two inner panels, through which the inner pipe passes, it is not necessary to establish a direct connection of the outer pipe to the inner pipe. This simplifies the configuration, because the muffling unit can be manufactured in a simple manner with the inner pipe, the outer pipe and the muffling material, e.g., by the intermediate space formed between the inner pipe and the outer pipe being filled with the muffling material after the inner pipe is positioned in the outer pipe. Additional actions for establishing a permanent connection of the outer pipe to the inner pipe are not necessary.

For example, a permanent integration of the muffling unit can be guaranteed by the outer pipe being connected by welding to the inner panel or/and to one of the outer panels or to an additional inner panel.

In order to be able to ensure the defined positioning of the outer pipe in relation to the inner panel, on the one hand, and of one of the outer panels or of the additional panel, on the other hand, in a simple manner, an axial bulge accommodating the outer pipe may be formed in the inner panel or/and in one of the outer panels or in the additional inner panel. Provisions are preferably made here for the axial bulge formed in the inner panel and the axial bulge formed in one of the outer panels or in the additional inner panel to be oriented axially away from one another for a simple accommodation of the muffling unit.

Provisions may advantageously be made here for the opening provided in the inner panel to be provided in the area of the axial bulge formed in the inner panel, or/and for the opening formed in one of the outer panels or in the additional inner panel to be provided in the area of the axial bulge formed in one of the outer panels or in the additional inner panel.

In order to also ensure a permanent and defined positioning of the inner pipe in a simple manner, a neck, which encloses the inner pipe, is oriented axially away in the direction of the axial bulge provided in the inner panel and encloses the opening formed in the inner panel, may be provided at the inner panel, or/and that a neck, which encloses the inner pipe, is oriented axially away in the direction of the axial bulge provided in the outer panel or in the additional inner panel and encloses the opening formed in the outer panel or in the additional inner panel, may be provided at one of the outer panels or the additional inner panel. Because the neck is oriented axially away in the direction of a respective bulge, i.e., it is not positioned in a manner meshing with the interior provided by the bulge, in which interior the outer pipe and also the muffling material can be positioned in a meshing manner, a mutual interference of such a neck especially with the muffling material can be avoided.

A permanent connection of the inner pipe can be achieved here by the inner pipe being permanently connected, preferably by welding, to the neck provided at the inner panel, or/and by the inner pipe being permanently connected, preferably by welding, to the neck provided at one of the outer panels or at the additional inner panel. Further, provisions may be made for a simple configuration for the neck provided at the inner panel and for the neck provided at one of the outer panels or at the additional inner panel to be oriented axially away from one another.

For a simple configuration, the outer pipe may have a radial distance to the inner pipe in each of its axial end areas, or/and that the outer pipe have a cylindrical configuration.

In order to be able to make use of the muffling characteristic of the muffling material efficiently, a plurality of openings passing through a pipe wall of the inner pipe may be provided in the length area of the inner pipe, which length area is enclosed by the muffling material.

For an efficient reduction of the noise level, it is further provided that the muffling material essentially entirely fill up an intermediate space formed between the outer pipe and the inner pipe.

For example, the muffling material may comprise fiber material or/and foamed material.

The inner panel or/and one of the outer panels or the additional inner panel may be provided in a simple manner as a shaped sheet metal part having the structure to be provided according to the present invention.

The present invention further pertains to an exhaust system, comprising a muffler that is configured according to the present invention.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 is a simplified longitudinal sectional view showing a length area of a muffler for an exhaust system of an internal combustion engine.

DESCRIPTION OF PREFERRED EMBODIMENTS

Referring to the drawings, FIG. 1 shows an end area of a muffler, which is generally designated by 10, for an exhaust system of an internal combustion engine in a vehicle. For example, such a muffler 10 may be provided as a rear muffler in the end area of the exhaust system.

The muffler 10 comprises a muffler housing 12 with a housing jacket 14, which is, for example, essentially cylindrical and is elongated in the direction of a housing longitudinal axis A. This muffler is permanently connected, for example, by flanging or/and welding, to outer panels 16, 16' at both axial end areas of the housing jacket 14, so that the housing jacket 14 defines with the two outer panels 16, 16' a housing interior 18.

An inner panel 20, which is at an axial distance to the outer panel 16, is provided in the housing interior 18 in the example shown. The inner panel 20 divides the housing interior 18 into a plurality of space areas, so that a chamber 22 is formed between the outer panel 16 and the inner panel 20 shown in the exemplary embodiment being shown. The inner panel 20 may have, for example, a perforation, for the sake of muffling, so that the chamber 22 is open to the remaining area of the housing interior 18 and thus can form a resonator chamber.

A muffling unit generally designated by the reference number 24 comprises an exhaust-gas-carrying inner pipe 26 as well as an outer pipe 28, which encloses the inner pipe 26 and has an essentially cylindrical shape. An intermediate space 30 formed between the inner pipe 26 and the outer pipe 28 is essentially entirely filled with muffling material 32.

The muffling unit 24 may be provided as a preassembled assembly unit for the muffler 10. The inner pipe 26 may be positioned in the outer pipe 28 for this and the intermediate space 30 formed between them can then be filled with the muffling material 32. The muffling material 32 may be, for example, foamed material, which is injected into the intermediate space 30 after the defined positioning of the inner pipe 26 in relation to the outer pipe 28. The muffling material 32 may, as an alternative, also comprise fiber material, which is stuffed into the intermediate space 30 or can be wound around the inner pipe 26, for example, in the form of a fiber mat before inserting the inner pipe 26 into the outer pipe 28 and can then be inserted together with the inner pipe 26 into the outer pipe 28.

It is seen that due to its cylindrical shape, the outer pipe 28 has a radial distance to the inner pipe 26 in its two axial end areas 34, 36 as well as in the length areas located between them and in particular is not directly connected to this inner pipe 26 in any length area. A holding together of this muffling unit 24 is guaranteed via the muffling material 32 arranged between the inner pipe 26 and the outer pipe 28. In order to be able to efficiently utilize the muffling characteristic of the muffling material 32, a perforation with a plurality of openings 35 passing through a pipe wall 33 of same is provided in the inner pipe 26.

In the case of the muffler 10 shown in FIG. 1, the muffling assembly unit 24 is arranged between the outer panel 16 shown in this FIGURE and the inner panel 20 arranged at an axial distance thereto and is held on it. The outer panel 16 has for this purpose an axial bulge 38, which is dimensioned and adapted to the circumferential contour of the outer pipe 28 such that this outer pipe 28 can be inserted with light press fit with its axial end area 34, for example, axially into the axial bulge 38 or into the space area formed therein. An opening 40, which is enclosed by a neck 42, which is likewise provided at the outer panel 16, is formed at the outer panel 16 in an area located centrally in the axial bulge 38. The inner pipe 26, protruding axially over the outer pipe 28 or the muffling material 32, meshes, with its axial end area 44, with the opening 40 or with the neck 42. Here as well, the dimensioning of the opening 40 and of the neck 42 may be selected or coordinated with the outer circumferential contour of the inner pipe 26 in its axial end area 44 such that the inner pipe 26 is accommodated with slight press fit in the opening 40 or in the neck 42, and possibly also protrudes over the neck 42 slightly outwards. Because the neck 42 is oriented axially away in the direction of the bulge 38 and does not mesh with the bulge 38 or with the interior provided by this bulge 38, there is no interaction between the neck 42 and the muffling material 32 positioned in a manner meshing with the bulge, which interaction makes the assembly difficult.

An axial bulge 46 is also provided in the inner panel 20. This bulge 46 is oriented away from the axial bulge 38 provided in the outer panel 16 and accommodates the axial end area 36 of the outer pipe 28 or the part of the muffling material 32 also provided in this axial end area 36 of the outer pipe 28. Here as well, the axial bulge 46 is preferably adapted in terms of shape and dimensioning to the shape and dimensioning of the outer pipe 28 in its axial end area 36, so that the outer pipe 28 with its axial end area 36 can be accommodated with slight press fit in the axial bulge 46.

An opening 48 accommodating an end area 49 of the inner pipe 26 and through which this inner pipe 26 passes, is provided in the central area of the axial bulge 46 of the inner panel 20 and is enclosed by a neck 50 formed at the inner panel 20 and extending approximately axially. The neck 50 is oriented away from the axial bulge 46, i.e., the interior formed in this bulge 46, so that here as well there is no mutual interference with the area of the muffling material 32, which area meshes with the axial bulge 46. In particular, it is seen that the neck is also oriented away from the outer panel 16, so that the neck 42 provided at the outer panel 16 and the neck 50 provided at the inner panel 20 are oriented away from one another.

A permanent holding together of the different components and assembly units can be achieved by connection in substance, i.e., for example, by welding. Thus, the inner panel 20 is preferably fixed to the housing jacket 14 by a weld 52, for example, a continuous weld seam or a plurality of welding spots. To ensure a tight closure against the discharge of exhaust gas, the inner pipe 26 is fixed in an inner pipe axial end area to the outer panel 16, preferably to the neck 42 of same, by a weld 52, preferably a continuous weld seam. In a corresponding manner, even though this is not absolutely necessary for the sake of passage of exhaust gas, the inner pipe 26 in an inner pipe other axial end area 49 may also be fixed to the inner panel 20, preferably to the neck 50 of same, by a weld 56, preferably again by a continuous weld seam. In particular, a connection in substance of the outer pipe 28 to the panel 20 in the area of a weld 58, which can preferably in turn be configured as a continuous weld seam or a plurality of welding spots arranged at spaced locations from one another, ensures a permanent connection of the muffling assembly unit 24. As an alternative or in addition, the outer pipe 28 can be fixed to the outer panel 16 by a weld 60, wherein the weld 60 may also comprise a continuous weld seam or a plurality of welding spots arranged at spaced locations from one another. If the outer pipe 28 is fixed in the outer pipe two axial end areas 34, 36 to the outer panel 16 and to the inner panel 20 by welding, as a result of which a relatively rigid connection of these two panels to one another is established as well, it may be advantageous not to connect the inner pipe 26 in the inner pipe end area 49 rigidly to the inner panel 20 because of the different thermal expansions of the inner pipe 26, on the one hand, and of the outer pipe 28, on the other hand, which are to be expected during the operation.

A stable hold of the muffling unit 24 in the muffler 10 is guaranteed by the permanent connection of the outer pipe 28 at the inner panel 20 or/and at the outer panel 16, each adjoining the respective axial bulge 38 or 46 formed therein. This can be supported by the permanent connection of the inner pipe 26 in at least one of its two end areas 44, 49 at the outer panel 16 or at the inner panel 20.

It should be pointed out that the principles of the present invention may also be utilized when the muffling unit 24 is carried or fixed in its two axial end areas or in the two axial end areas 34, 36 of the outer pipe 28 at two inner panels 20, 20' arranged in the housing interior 18 of the muffler 10.

While specific embodiments of the invention have been shown and described in detail to illustrate the application of the principles of the invention, it will be understood that the invention may be embodied otherwise without departing from such principles.

What is claimed is:

1. A muffler for an exhaust system of an internal combustion engine, the muffler comprising:

a muffler housing comprising a housing jacket elongated in a direction of a housing longitudinal axis, and an outer panel connected to the housing jacket at each of two axial end areas of the housing jacket, wherein the housing jacket with the outer panel defines a muffler interior;

at least one inner panel arranged in the muffler interior and dividing the muffler interior; and a muffling unit comprising an exhaust-gas-carrying inner pipe, an outer pipe enclosing the inner pipe, and muffling material arranged between the inner pipe and the outer pipe, wherein the inner pipe is accommodated in an opening of the inner panel and in an opening of one of the outer panels or an opening of the inner panel and an opening of an additional inner panel, and the outer pipe is permanently connected to the inner panel and to one of the outer panels or to the inner panel and to an additional inner panel, wherein the outer pipe has a radial distance to the inner pipe in each of axial end areas, such as to be not directly connected to the inner pipe in each of the axial end areas.

2. A muffler in accordance with claim 1, wherein:

the outer pipe is connected by a weld connection to the inner panel; or the outer pipe is connected by a weld connection to one the outer panels; or the outer pipe is connected by a weld connection to the additional inner panel; or any combination of the outer pipe is connected by a weld connection to the inner panel, and the outer pipe is connected by a weld connection to one the outer panels, and the outer pipe is connected by a weld connection to the additional inner panel.

3. A muffler in accordance with claim 1, wherein:

an axial bulge accommodating the outer pipe is formed in the inner panel; or an axial bulge accommodating the outer pipe is formed in one of the outer panels; or an axial bulge accommodating the outer pipe is formed in the additional inner panel; or any combination of an axial bulge accommodating the outer pipe is formed in the inner panel, and an axial bulge accommodating the outer pipe is formed in one of the outer panels and an axial bulge accommodating the outer pipe is formed in the additional inner panel.

4. A muffler in accordance with claim 3, wherein:

the opening provided in the inner panel is located in an area of the axial bulge formed in the inner panel; or the opening provided in one of the outer panels is located in an area of the axial bulge formed in one of the outer panels; or the opening provided in the additional inner panel is located in an area of the axial bulge formed in the additional inner panel; or any combination of the opening provided in the inner panel is located in an area of the axial bulge formed in the inner panel, and the opening provided in one of the outer panels is located in an area of the axial bulge formed in one of the outer panels, and the opening provided in the additional inner panel is located in an area of the axial bulge formed in the additional inner panel.

5. A muffler in accordance with claim 3, wherein the axial bulge formed in the inner panel or the axial bulge formed in one of the outer panels or the axial bulge formed in the additional inner panel are oriented axially away from one another.

6. A muffler in accordance with claim 4, wherein:

the inner panel has a neck which encloses the inner pipe and is oriented axially away from a direction of the axial bulge of the inner panel, and encloses the opening formed in the inner panel; or the outer panel has a neck which encloses the inner pipe and is oriented axially away from a direction of the axial bulge provided in the outer panel and encloses the opening formed in the outer panel; or the additional inner panel has a neck which encloses the inner pipe and is oriented axially away from a direction of the axial bulge provided in the additional inner panel and encloses the opening formed in the additional inner panel; or any combination of the inner panel has a neck which encloses the inner pipe and is oriented axially away from a direction of the axial bulge of the inner panel, and encloses the opening formed in the inner panel, and the outer panel has a neck which encloses the inner pipe and is oriented axially away from a direction of the axial bulge provided in the outer panel and encloses the opening formed in the outer panel, and the additional inner panel has a neck which encloses the inner pipe and is oriented axially away from a direction of the axial bulge provided in the additional inner panel and encloses the opening formed in the additional inner panel.

7. A muffler in accordance with claim 6, wherein:

the inner pipe is permanently connected to the neck provided at the inner panel; or the inner pipe is permanently connected to the neck provided at one of the outer panels; or the inner pipe is permanently connected to the neck provided at the additional inner panel; or any combination of the inner pipe is permanently connected to the neck provided at the inner panel, and the inner pipe is permanently connected to the neck provided at one of the outer panels, and the inner pipe is permanently connected to the neck provided at the additional inner panel.

8. A muffler in accordance with claim 6, wherein:

the neck provided at the inner panel is oriented axially away from the neck provided at one of the outer panels; or the neck provided at the inner panel is oriented axially away from the neck provided at the additional inner panel.

9. A muffler in accordance with claim 1, wherein the outer pipe has a cylindrical configuration.

10. A muffler in accordance with claim 1, wherein:

the inner pipe comprises an inner pipe wall;

the inner pipe wall has a length area that is enclosed by the muffling material; and the length area of the inner pipe wall has a plurality of openings passing through the inner pipe wall.

11. A muffler in accordance with claim 1, wherein:

an intermediate space is formed between the outer pipe and the inner pipe; and the muffling material essentially entirely fills up the intermediate space formed between the outer pipe and the inner pipe.

12. A muffler in accordance with claim 1, wherein:

the muffling material comprises fiber material; or the muffling material comprises foamed material; or the muffling material comprises fiber material and foamed material.

13. A muffler in accordance with claim 1, wherein:

the inner panel is a shaped sheet metal part; or at least one of the outer panels is a shaped sheet metal part; or the additional inner panel is a shaped sheet metal part; or any of the inner panel, and at least one of the outer panels, and the additional inner panel is a shaped sheet metal part.

14. An exhaust system comprising a muffler, the muffler comprising:

a muffler housing comprising a housing jacket elongated in a direction of a housing longitudinal axis, and an outer panel connected to the housing jacket at each of two axial end areas of the housing jacket, wherein the housing jacket with the outer panel defines a muffler interior;

at least one inner panel arranged in the muffler interior and dividing the muffler interior; and a muffling unit comprising an exhaust-gas-carrying inner pipe, an outer pipe enclosing the inner pipe, and muffling material arranged between the inner pipe and the outer pipe, wherein the inner pipe is accommodated in an opening of the inner panel and in an opening of one of the outer panels or an opening of the inner panel and an opening of an additional inner panel, and the outer pipe is permanently connected to the inner panel and to one of the outer panels or to the inner panel and to an additional inner panel, wherein the outer pipe has a radial distance to the inner pipe in each of axial end areas, such as to be not directly connected to the inner pipe in each of the axial end areas.

15. An exhaust system in accordance with claim 14, wherein:

the outer pipe is connected by a weld connection to the inner panel; or the outer pipe is connected by a weld connection to one the outer panels; or the outer pipe is connected by a weld connection to the additional inner panel; or any combination of the outer pipe is connected by a weld connection to the inner panel, and the outer pipe is connected by a weld connection to one the outer panels, and the outer pipe is connected by a weld connection to the additional inner panel.

16. An exhaust system in accordance with claim 14, wherein:

an axial bulge accommodating the outer pipe is formed in the inner panel; or an axial bulge accommodating the outer pipe is formed in one of the outer panels; or an axial bulge accommodating the outer pipe is formed in the additional inner panel; or any combination of an axial bulge accommodating the outer pipe is formed in the inner panel, and an axial bulge accommodating the outer pipe is formed in one of the outer panels and an axial bulge accommodating the outer pipe is formed in the additional inner panel.

17. An exhaust system in accordance with claim 16, wherein:

the opening provided in the inner panel is located in an area of the axial bulge formed in the inner panel; or the opening provided in one of the outer panels is located in an area of the axial bulge formed in one of the outer panels; or the opening provided in the additional inner panel is located in an area of the axial bulge formed in the additional inner panel; or any combination of the opening provided in the inner panel is located in an area of the axial bulge formed in the inner panel, and the opening provided in one of the outer panels is located in an area of the axial bulge formed in one of the outer panels, and the opening provided in the additional inner panel is located in an area of the axial bulge formed in the additional inner panel; or the axial bulge formed in the inner panel or the axial bulge formed in one of the outer panels or axial bulge formed in the additional inner panel are oriented axially spaced apart from one another.

18. An exhaust system in accordance with claim 17, wherein:

the inner panel has a neck which encloses the inner pipe and is oriented axially away from a direction of the axial bulge of the inner panel, and encloses the opening formed in the inner panel; or the outer panel has a neck which encloses the inner pipe and is oriented axially away from a direction of the axial bulge provided in the outer panel and encloses the opening formed in the outer panel; or the additional inner panel has a neck which encloses the inner pipe and is oriented axially away from a direction of the axial bulge provided in the additional inner panel and encloses the opening formed in the additional inner panel; or any combination of the inner panel has a neck which encloses the inner pipe and is oriented axially away from a direction of the axial bulge of the inner panel, and encloses the opening formed in the inner panel, and the outer panel has a neck which encloses the inner pipe and is oriented axially away from a direction of the axial bulge provided in the outer panel and encloses the opening formed in the outer panel, and the additional inner panel has a neck which encloses the inner pipe and is oriented axially away from a direction of the axial bulge provided in the additional inner panel and encloses the opening formed in the additional inner panel.

19. An exhaust system in accordance with claim 18, wherein:

the inner pipe is permanently connected to the neck provided at the inner panel; or the inner pipe is permanently connected to the neck provided at one of the outer panels; or the inner pipe is permanently connected to the neck provided at the additional inner panel; or any combination of the inner pipe is permanently connected to the neck provided at the inner panel, and the inner pipe is permanently connected to the neck provided at one of the outer panels, and the inner pipe is permanently connected to the neck provided at the additional inner panel; or the neck provided at the inner panel is oriented axially away from the neck provided at one of the outer panels; or the neck provided at the inner panel is oriented axially away from the neck provided at the additional inner panel.

20. An exhaust system in accordance with claim 14, wherein:

the inner pipe comprises an inner pipe wall;

the inner pipe wall has a length area that is enclosed by the muffling material; and the length area of the inner pipe wall has a plurality of openings passing through the inner pipe wall.

* * * * *